US012060721B2

(12) United States Patent
Ferrier et al.

(10) Patent No.: US 12,060,721 B2
(45) Date of Patent: Aug. 13, 2024

(54) ANCHOR

(71) Applicant: Illinois Tool Works Inc., Glenview, IL (US)

(72) Inventors: Ian Ross Ferrier, Wantirna South (AU); Jeffrey Pellerin, Hallett Cove (AU)

(73) Assignee: Illinois Tool Works Inc., Glenview, IL (US)

( * ) Notice: Subject to any disclaimer, the term of this patent is extended or adjusted under 35 U.S.C. 154(b) by 28 days.

(21) Appl. No.: 17/864,977

(22) Filed: Jul. 14, 2022

(65) Prior Publication Data

US 2023/0017332 A1 Jan. 19, 2023

(30) Foreign Application Priority Data

Jul. 14, 2021 (AU) ..... 2021205063

(51) Int. Cl.
*E04G 21/14* (2006.01)

(52) U.S. Cl.
CPC ..... *E04G 21/142* (2013.01)

(58) Field of Classification Search
CPC ..... E04G 21/142; E04G 21/147; E04C 5/125; E04B 1/4107
See application file for complete search history.

(56) References Cited

U.S. PATENT DOCUMENTS 4,702,045 A 10/1987 Fricker
5,596,846 A 1/1997 Kelly
D422,894 S 4/2000 Kubica
D521,159 S 5/2006 Hansort
D540,657 S 4/2007 Hansort
7,934,343 B2 * 5/2011 Fletcher ..... E04G 21/142 52/125.5
8,096,086 B2 * 1/2012 Fletcher ..... E04G 21/142 52/707
D686,486 S 7/2013 Densmore et al.
8,898,964 B1 12/2014 Francies
(Continued)

FOREIGN PATENT DOCUMENTS

AU 2019279923 A1 6/2020
DE 20115328 U1 12/2001
(Continued)

OTHER PUBLICATIONS

European Search Report from European Application No. 22184165.3, mailed Feb. 21, 2023 (9 pages).

*Primary Examiner* — Adriana Figueroa
(74) *Attorney, Agent, or Firm* — Neal, Gerber & Eisenberg LLP

(57) ABSTRACT

An anchor for embedment in a concrete body for lifting the concrete body, wherein the anchor includes a head having a lifting aperture for engagement with a lifting device, and a pair of legs adapted for embedment within the concrete body, wherein the head has an additional aperture having at least a portion of the additional aperture bordered by a border rib, wherein a lower edge of the head is provided with a cross rib which extends between the pair of legs, and wherein webbing extends between the border rib and the cross rib such that a cross-section along a longitudinal axis of the anchor between the cross rib and the border rib forms an I-beam.

8 Claims, 8 Drawing Sheets

(56) References Cited

U.S. PATENT DOCUMENTS

| | | | | |
|---|---|---|---|---|
| 9,617,746 | B1 * | 4/2017 | Francies, III | E04G 15/04 |
| 10,240,356 | B2 | 3/2019 | Mackay Sim | |
| 10,309,115 | B2 * | 6/2019 | Barraclough | E04G 21/142 |
| 10,626,626 | B2 * | 4/2020 | Barraclough | E04G 21/142 |
| 10,840,679 | B2 | 11/2020 | Vaccaro et al. | |
| 11,421,431 | B1 | 8/2022 | Jablonsky | |
| 2003/0213206 | A1 | 11/2003 | Hansort | |
| 2004/0159069 | A1 | 8/2004 | Hansort | |
| 2004/0159070 | A1 | 8/2004 | Hansort | |
| 2005/0044811 | A1 | 3/2005 | Hansort | |
| 2006/0248813 | A1 | 11/2006 | Fletcher et al. | |
| 2008/0196324 | A1 * | 8/2008 | Mackay Sim | E04G 21/142 52/125.4 |
| 2009/0205268 | A1 | 8/2009 | Fletcher | |
| 2009/0320386 | A1 | 12/2009 | Mackay | |
| 2012/0227335 | A1 | 9/2012 | Eklund et al. | |
| 2013/0091785 | A1 | 4/2013 | Sladojevic | |
| 2013/0139451 | A1 | 6/2013 | Sladojevic | |
| 2015/0075090 | A1 | 3/2015 | Barraclouch | |
| 2015/0101266 | A1 | 4/2015 | Barraclough | |
| 2017/0247892 | A1 | 8/2017 | Hansort | |

FOREIGN PATENT DOCUMENTS

| | | | |
|---|---|---|---|
| EP | 1712705 | A2 | 10/2006 |
| EP | 3428109 | A1 | 1/2019 |
| FR | 2931857 | A1 | 12/2009 |
| JP | D1341167 | | 10/2008 |
| NZ | 403324-0001 | | 9/2003 |
| NZ | 421204-0001 | | 2/2017 |
| NZ | 421205-0001 | | 2/2017 |
| NZ | 421207-0001 | | 2/2017 |
| WO | 2011006189 | A1 | 1/2011 |
| WO | 2013163393 | A1 | 10/2013 |

* cited by examiner

SECTION A-A

SECTION B-B

SECTION C-C

ANCHOR

PRIORITY CLAIM

The present application claims priority to and the benefit of Australian Patent Application No. 2021205063, filed Jul. 14, 2021, the entire contents of which are incorporated herein by reference.

FIELD

The present disclosure relates to an anchor for concrete.

BACKGROUND

It is known to provide an anchor for embedment in concrete for lifting of concrete parts. However, the applicant has identified that it would be advantageous to have an improved anchor with optimised performance.

In particular, the applicant has identified that it would be beneficial to provide an anchor with improved strength and performance by way of varying a configuration of a head portion of the anchor.

Examples of the present disclosure seek to provide an improved anchor for concrete which obviates or at least ameliorates one or more disadvantages of existing anchors.

SUMMARY

In accordance with one aspect of the present disclosure, there is provided an anchor for embedment in a concrete body for lifting the concrete body, wherein the anchor includes a head having a lifting aperture for engagement with a lifting device, and a pair of legs adapted for embedment within the concrete body, wherein the head has an additional aperture having at least a portion of the additional aperture bordered by a rib.

Preferably, a lower end of the additional aperture is bordered by a curved part of the rib. More preferably, the curved part of the rib terminates at each end in a straight rib. Even more preferably, the straight ribs are mutually parallel. In one form, the straight ribs run parallel with a longitudinal axis of the anchor.

In accordance with another aspect of the present disclosure, there is provided an anchor for embedment in a concrete body for lifting the concrete body, wherein the anchor includes a head having a lifting aperture for engagement with a lifting device, and a pair of legs adapted for embedment within the concrete body, wherein a lower edge of the head is provided with a cross rib which extends between the pair of legs.

Preferably, the cross rib is indented upwardly at a central portion thereof.

In accordance with another aspect of the present disclosure, there is provided an anchor for embedment in a concrete body for lifting the concrete body, wherein the anchor includes a head having a lifting aperture for engagement with a lifting device, and a pair of legs adapted for embedment within the concrete body, wherein the head has an additional aperture having at least a portion of the additional aperture bordered by a border rib, wherein a lower edge of the head is provided with a cross rib which extends between the pair of legs, and wherein webbing extends between the border rib and the cross rib such that a cross-section along a longitudinal axis of the anchor between the cross rib and the border rib forms an I-beam.

In accordance with yet another aspect of the present disclosure, there is provided an anchor for embedment in a concrete body for lifting the concrete body, wherein the anchor includes a head having a lifting aperture for engagement with a lifting device, and a pair of legs adapted for embedment within the concrete body, wherein the head is provided with a neck formed such that a narrowest part of the neck lies in a transverse plane travelling through the lifting aperture.

BRIEF DESCRIPTION OF THE DRAWINGS

The present disclosure is further described by way of non-limiting example only with reference to the accompanying drawings, in which.

DETAILED DESCRIPTION

Figure 1:
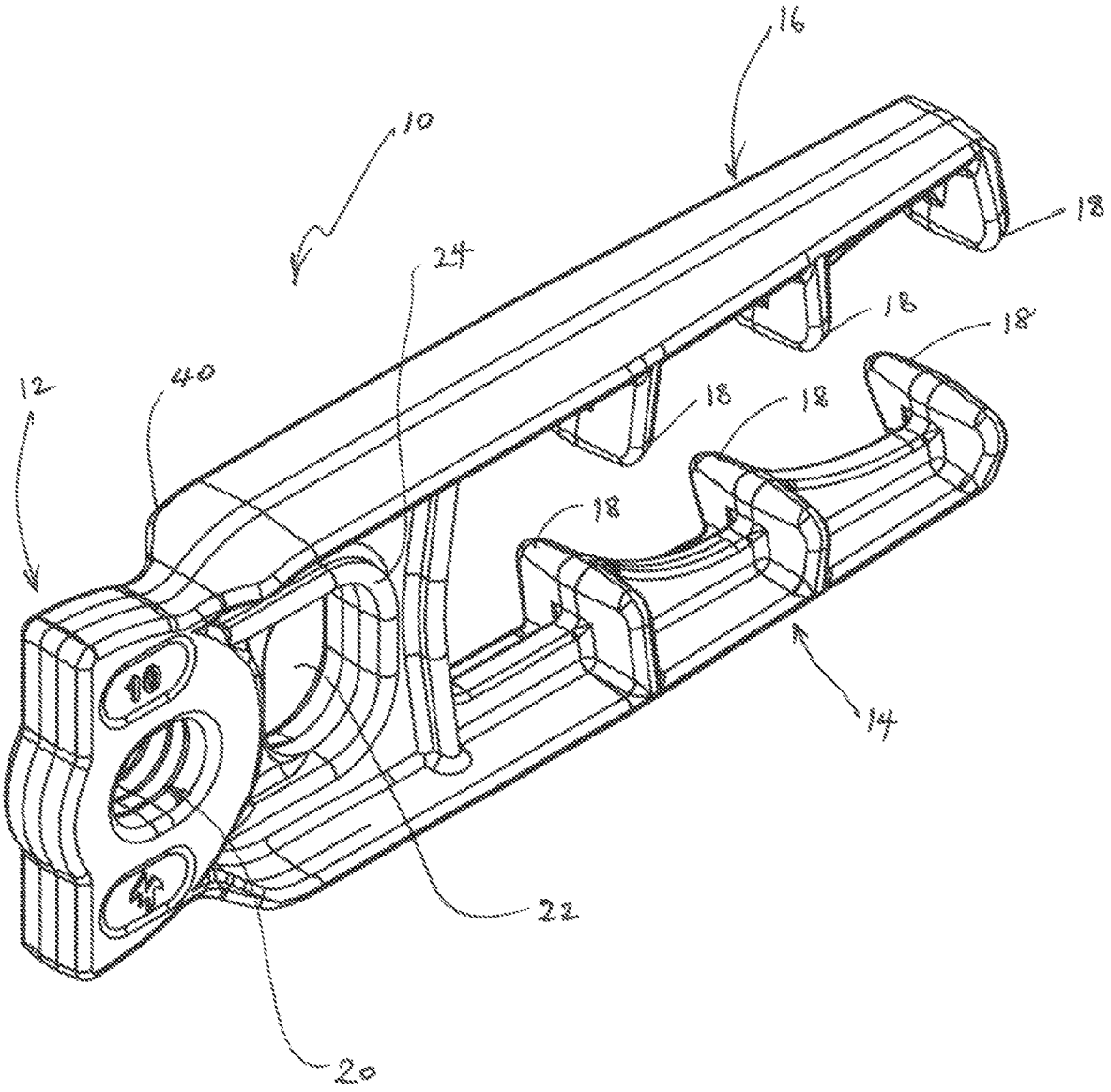
FIG. 1 shows a perspective view of an anchor in accordance with an example of the present disclosure.

As can be seen in FIGS. 1 to 10 of the drawings, there is shown an anchor 10 for embedment in a concrete body for lifting the concrete body, in accordance with an example of the present disclosure. The anchor 10 includes a head 12 having a lifting aperture 20 for engagement with a lifting device, and a pair of legs 14, 16. The legs 14, 16 are adapted for embedment within the concrete body and may each be provided with a series of locking formations 18 for improving embedment of the anchor 10 within the concrete body. In the example shown, the head 12 has an additional aperture 22 having at least a portion of the additional aperture bordered by a rib 24.

Figure 2:
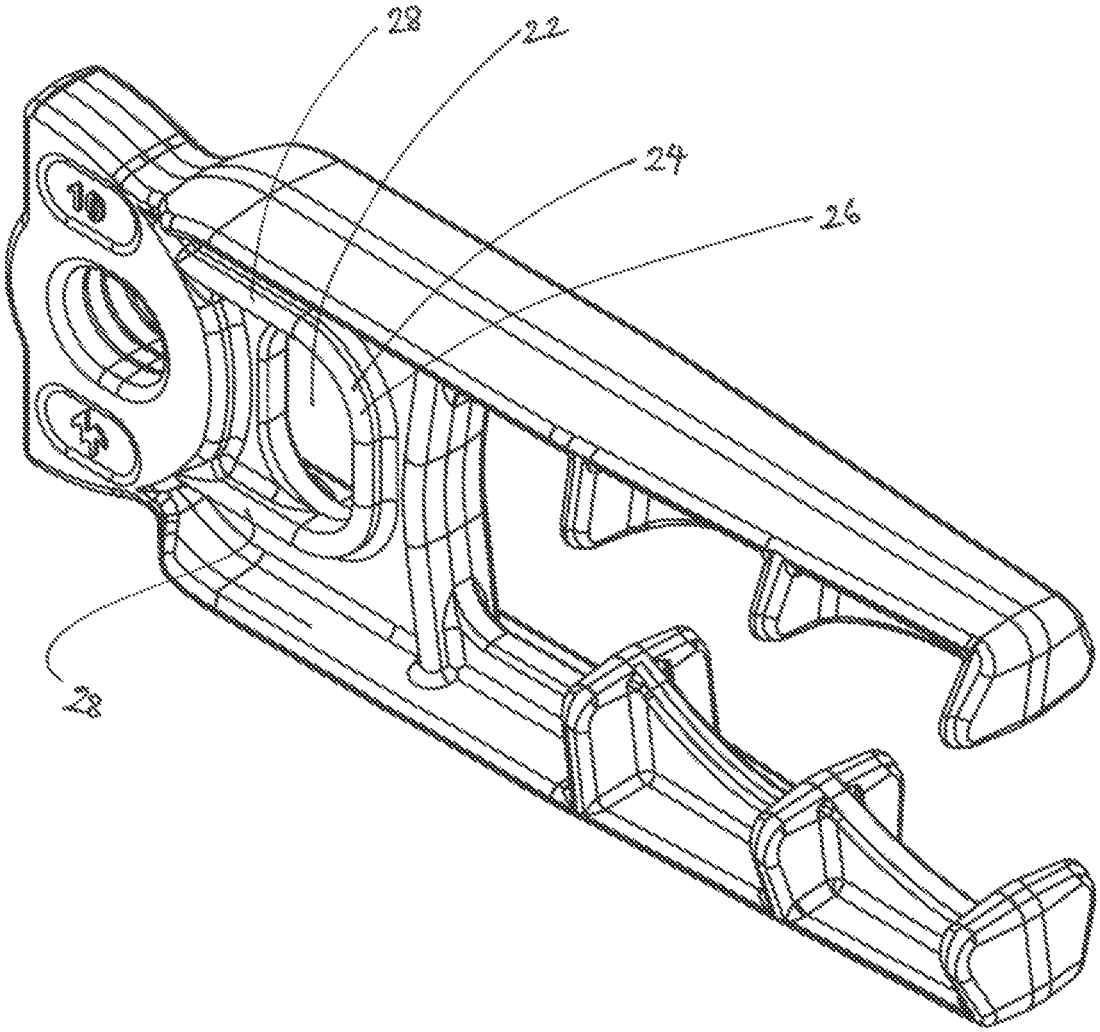
FIG. 2 shows another perspective view of the anchor.

More specifically, as shown in FIG. 2, a lower end of the additional aperture 22 is bordered by a curved part 26 of the rib 24. In the example shown in the drawings, the curved part 26 of the rib 24 terminates at each end in a straight rib 28. The straight ribs 28 are mutually parallel and, in this particular example shown in the drawings, the straight ribs 28 run parallel with a longitudinal axis of the anchor 10.

Figure 3:
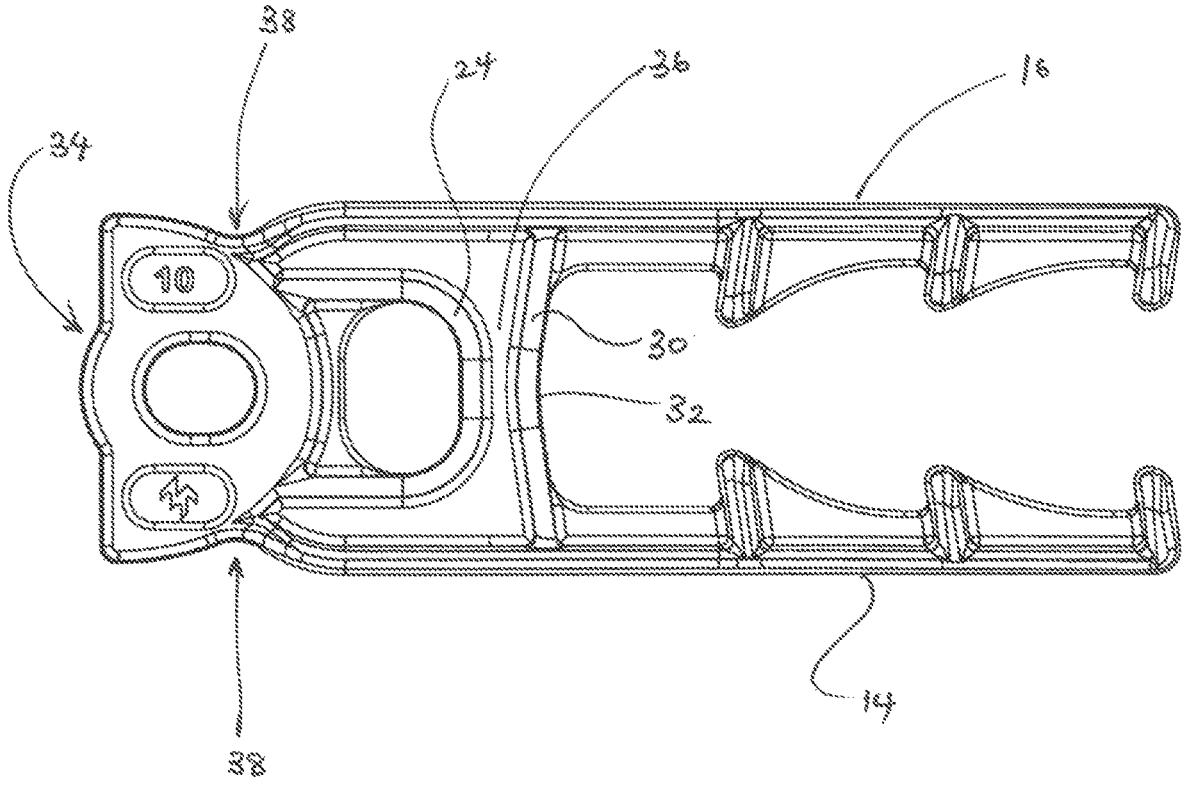
FIG. 3 shows a side view of the anchor.
Figure 4:
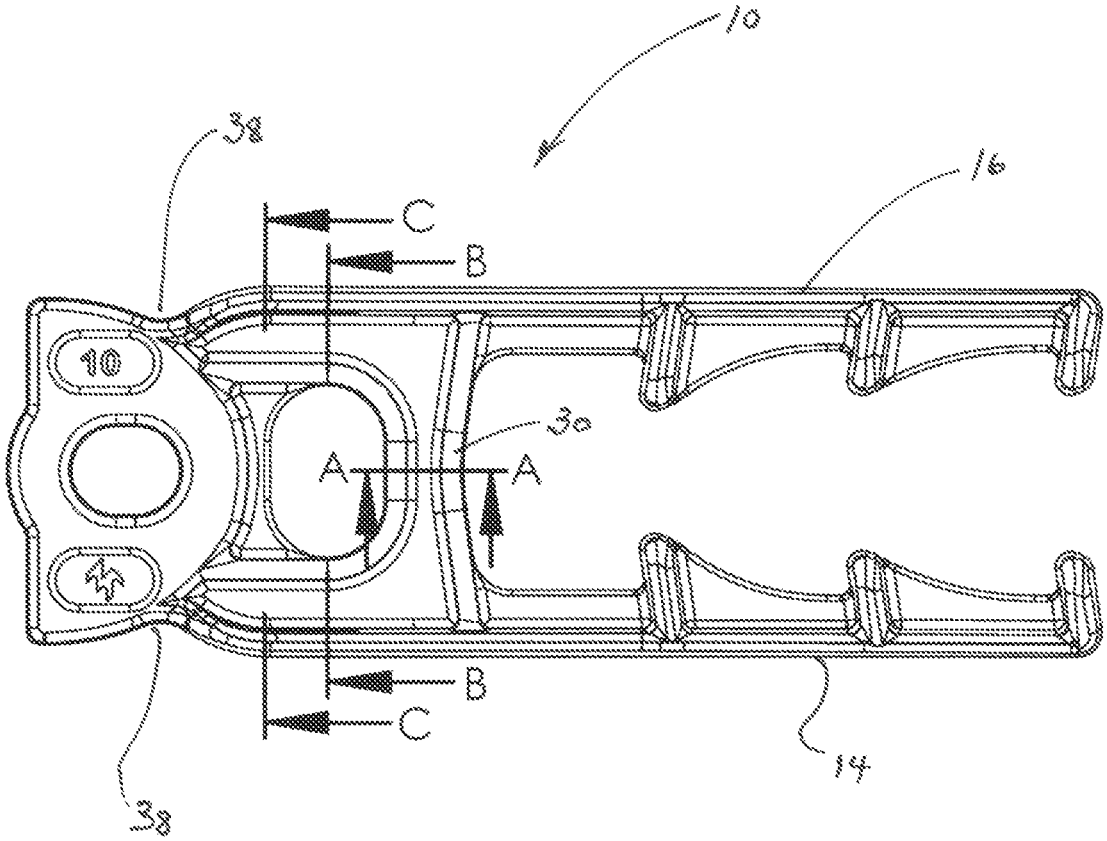
FIG. 4 shows a side view of the anchor, depicting lines along which cross sections are taken for subsequent views (FIGS. 8 to 10)
Figure 5:
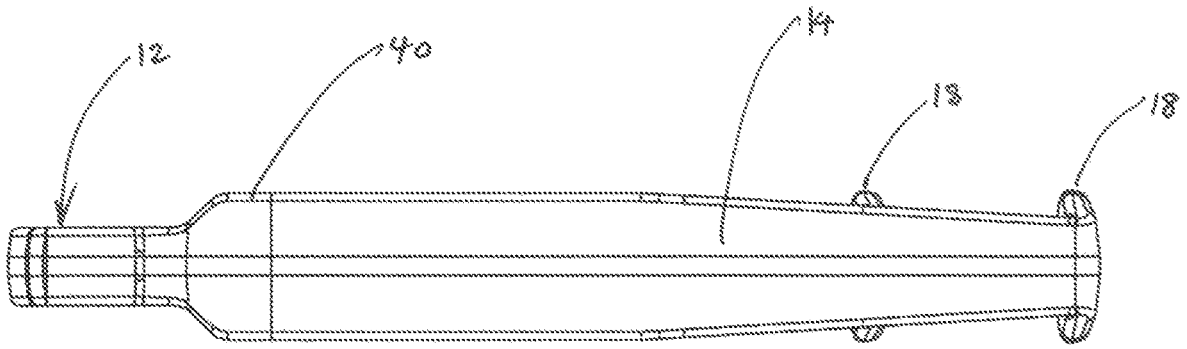
FIG. 5 shows an edge view of the anchor.
Figure 6:
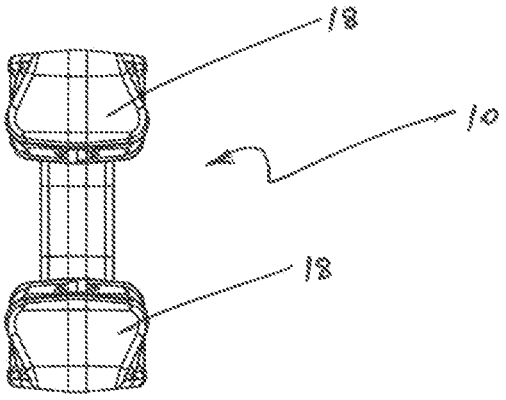
FIG. 6 shows a bottom view of the anchor.
Figure 7:
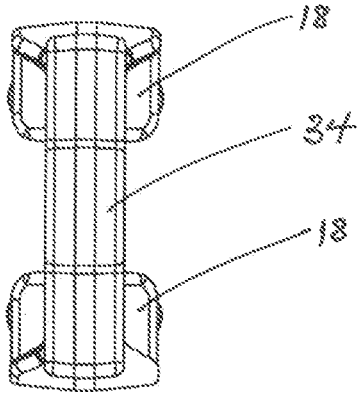
FIG. 7 shows a top view of the anchor.

With reference to FIG. 3, the head 12 has the lifting aperture 20 for engagement with a lifting device, and a lower edge of the head 12 is provided with a cross rib 30 which extends between the pair of legs 14, 16. As can be seen, the cross rib 30 is indented upwardly (toward a top end 34 of the head 12 as oriented during lifting) at a central portion 32 thereof.

Figure 8:
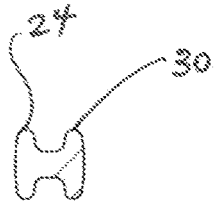
FIG. 8 shows a cross-sectional view taken along line A-A shown in FIG. 4.
Figure 9:
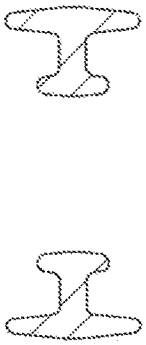
FIG. 9 shows a cross-sectional view taken along line B-B shown in FIG. 4.
Figure 10:
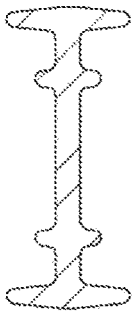
FIG. 10 shows a cross-sectional view taken along line C-C shown in FIG. 4.

In the example shown, the head 12 has webbing 36 extends between the border rib 24 and the cross rib 30 such that a cross-section along a longitudinal axis of the anchor 10 between the cross rib 30 and the border rib 24 forms an I-beam (see FIG. 8).

The head 12 may be provided with a neck 38 formed such that a narrowest part of the neck 38 lies in a transverse plane (transverse to a longitudinal axis of the anchor 10) travelling through the lifting aperture 20.

Advantageously, the applicant has determined that an anchor 10 formed in accordance with an example of the present disclosure may provide greater rigidity, with more resistance to folding at the neck 38. In addition, the border rib 24 forms a flange which adds extra rigidity to the head 12 in shear. The position and format of the cross rib 30 running across the anchor 10 have been configured to create an I-beam section between the tension bar hole 22 and the throat of the anchor 10. Furthermore, the applicant has run and outer flange 40 of the anchor 10 as far as possible up onto the head 12 of the anchor 10 to maximise the I-beam type strength/rigidity. Accordingly, the neck 38 of the anchor 10 is brought much closer to the top of the head 12. In this way, the neck 38 is much wider, significantly increasing rigidity through the neck 38.

While various embodiments of the present disclosure have been described above, it should be understood that they have been presented by way of example only, and not by way of limitation. It will be apparent to a person skilled in the relevant art that various changes in form and detail can be made therein without departing from the spirit and scope of the present disclosure. Thus, the present disclosure should not be limited by any of the above described exemplary embodiments.

he reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. An anchor for embedment in a concrete body for lifting the concrete body, the anchor comprising:

a head including:

an enclosed lifting aperture, the head being engageable by a lifting device extending through the lifting aperture, a neck, wherein a narrowest part of the neck lies in a transverse plane travelling through the lifting aperture, and an additional enclosed aperture; and a pair of legs extending from the head and configured to be embedded within the concrete body, wherein a lower edge of the head includes a cross rib that extends between the pair of legs and is indented upwardly at a central portion thereof, and wherein a lower end of the additional enclosed aperture is bordered by a border rib where a curved part of the border rib forms a flange.

2. The anchor of claim 1, wherein webbing extends between the border rib and the cross rib such that a cross-section along a longitudinal axis of the anchor between the cross rib and the border rib forms an I-beam.

3. The anchor of claim 1, wherein the curved part of the border rib terminates at each end in a straight rib.

4. The anchor of claim 3, wherein the straight ribs are mutually parallel.

5. The anchor of claim 4, wherein the straight ribs run parallel with a longitudinal axis of the anchor.

6. The anchor of claim 1, wherein the enclosed lifting aperture and the additional enclosed aperture are both oval shaped.

7. The anchor of claim 6, which includes a major axis of the enclosed lifting aperture is configured to extend vertically when the anchor is embedded in concrete.

8. The anchor of claim 7, wherein a major axis of the additional enclosed aperture is configured to extend horizontally when the anchor is embedded in concrete.

* * * * *